US008379898B2

(12) United States Patent
Nikles et al.

(10) Patent No.: US 8,379,898 B2
(45) Date of Patent: Feb. 19, 2013

(54) TRANSMISSION FACILITY FOR A HEARING APPARATUS WITH FILM CONDUCTOR SHIELDING AND NATURALLY SHIELDED COIL

(75) Inventors: Peter Nikles, Erlangen (DE); Gottfried Rückerl, Nürnberg (DE); Ulrich Schätzle, Forchheim (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1203 days.

(21) Appl. No.: 12/231,665

(22) Filed: Sep. 4, 2008

(65) Prior Publication Data

US 2009/0067649 A1 Mar. 12, 2009

(30) Foreign Application Priority Data

Sep. 7, 2007 (DE) ..... 10 2007 042 592

(51) Int. Cl.
*H04R 25/00* (2006.01)

(52) U.S. Cl. ..... 381/331; 381/312

(58) Field of Classification Search ..... 381/312, 381/314–316, 331; 607/55–57; 379/52, 379/55.1, 430

See application file for complete search history.

(56) References Cited

U.S. PATENT DOCUMENTS

| | | | | |
|---|---|---|---|---|
| 4,926,007 | A | 5/1990 | Aufderheide et al. | |
| 6,940,466 | B2 | 9/2005 | Terry | |
| 7,145,348 | B2 * | 12/2006 | Nakazaki et al. | 361/818 |
| 7,657,045 | B2 * | 2/2010 | Hochmair et al. | 381/331 |
| 8,126,563 | B2 * | 2/2012 | Ibrahim | 607/57 |
| 2006/0049995 | A1 | 3/2006 | Imaoka et al. | |
| 2006/0269088 | A1 | 11/2006 | Julstrom et al. | |

FOREIGN PATENT DOCUMENTS

DE 3143210 A1 5/1983

* cited by examiner

*Primary Examiner* — Suhan Ni

(57) ABSTRACT

Hearing apparatuses with transmission facilities for the wireless transmission are to be miniaturized further. A transmission facility for a hearing apparatus and in particular a hearing device with an oscillating circuit including a capacitor and a coil as well as an electrical line is provided in or to the oscillating circuit, with the electrical line having a shielding. The electrical line includes a film conductor with a signal line and shielding line, the shielding capacitance of which is connected in parallel to the capacitor of the oscillating circuit. The shielding capacitance can be used together with the capacitance of the capacitor in a targeted fashion as an oscillating circuit capacitance. In this way, the parasitic shielding capacitance is used as a wanted capacitance. As the shielding capacitance of the film conductor is only subjected to minimal fluctuations, it only requires a small tuning capacitor for tuning the oscillating circuit.

10 Claims, 4 Drawing Sheets

TRANSMISSION FACILITY FOR A HEARING APPARATUS WITH FILM CONDUCTOR SHIELDING AND NATURALLY SHIELDED COIL

CROSS REFERENCE TO RELATED APPLICATIONS

This application claims priority of German application No. 10 2007 042 592.0 filed Sep. 7, 2007, which is incorporated by reference herein in its entirety.

FIELD OF THE INVENTION

The present invention relates to a transmission facility for a hearing apparatus with an oscillating circuit including a capacitor and a coil as well as an electrical line in or to the oscillating circuit, with the electrical line comprising a shielding. The present invention also relates to an electric coil with a wire winding to be shielded. In particular, the present invention relates to a hearing apparatus with a coil and/or transmission facility of this type for the wireless reception and/or emission of signals. The term "hearing apparatus" is understood here to mean in particular a hearing device but also any other device for outputting sound which can be worn on or in the ear, like for instance a headset, earphones and suchlike.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

During the magnetic transmission of data (control data, programming data, audio data), E-field influences are unwanted since they may destructively overlay one another with the wanted signal from the magnetic field. The magnetic antennae (coil arrangements with and without ferrite core) as well as in particular their supply lines are affected by E-field injections. Conventional shields can generally not be deployed for use in miniaturized hearing devices for reasons of space and cost.

It is known to effectively shield E-fields with electrically conductive casings. The best known example of this is coaxial lines.

The patent application U.S. Pat. No. 6,940,466 B2 also discloses the shielding of ferrite cores with shielding films. This type of shielding of an antenna is associated with serious disadvantages particularly for hearing devices. The film surface namely has a high capacitive coupling to the windings arranged therebelow. The higher the working frequency, the lower the resistance of the alternating current resistor between the windings and the shielding film. This results in excessively high losses during emission and in a deterioration in the sensitivity during reception. If the capacitive coupling is to be kept to a minimum, the insulation must be selected to be very thick. As a result, the component becomes significantly larger and can no longer be used for miniaturized hearing devices.

SUMMARY OF THE INVENTION

The object of the present invention thus consists in proposing a transmission facility for a hearing apparatus with a shielded antenna feed line, whereby the installation space is to be reduced. In particular, a shielded antenna coil with a reduced installation space requirement is also to be provided.

This object is achieved in accordance with the invention by a transmission facility for a hearing apparatus with an oscillating circuit including a capacitor and a coil as well as an electrical supply line in or to the oscillating circuit, with the electrical line having a shielding and with the electrical line having a film conductor with a signal line and a shielding line, the shielding capacitance being connected in parallel to the capacitor and the shielding capacitance being used together with the capacitance of the capacitor in a targeted fashion as the oscillating circuit capacitance.

Provision is also made in accordance with the invention for an electrical coil with a wire winding including a first and a second wire end, with the wire winding being formed in one layer in an axial direction, starting with the first wire end, and a wire section on the second wire end being guided as a shield directly across the wire winding opposite to the axial direction.

By using the shielding capacitance, which is actually a parasitic capacitance, it is advantageously possible to reduce the capacitance of the necessary oscillating circuit capacitor and in this way to save on the installation space. Furthermore, the use of the film conductor is advantageous in that its capacitance can be very precisely determined, as a result of which the necessary tolerances can be reduced. As a result, the necessary tuning range is in turn reduced and a so-called "on-chip tuning" is possible, during which on-chip tuning capacitors are connected depending on requirements. The tuning capacitor required for the oscillating circuit of the transmission facility can then be integrated completely into a semiconductor chip.

The coil of the oscillating circuit preferably has a self-shielding formed itself by its winding wire. In particular, the self-shielding is formed like in the above-described electrical coil such that a wire end is guided as a shield directly across the wire winding opposite to the axial direction of the winding. Voluminous shielding components can be avoided in this way.

According to one embodiment, one of the signal lines and the shielding line can be short-circuited at one end of the electrical line of the oscillating circuit. The shielding is thus applied to the potential of the one line end and no special shielding potential needs to be guided at the electrical line.

Furthermore, the film conductor can comprise a conductor layer, which can be laterally discontinued and can thus be used both for the signal line as well as for the shielding line. Alternatively or in addition, the film conductor can comprise several conductor layers for the signal line and shielding line. As a result, the desired shielding effects can be achieved in parallel to or transverse to the backing film of the film conductor.

BRIEF DESCRIPTION OF THE DRAWINGS

The present invention is described in more detail with reference to the appended drawings, in which.

DETAILED DESCRIPTION OF THE INVENTION

The exemplary embodiments illustrated in more detail below represent preferred embodiments of the present invention.

Figure 1:
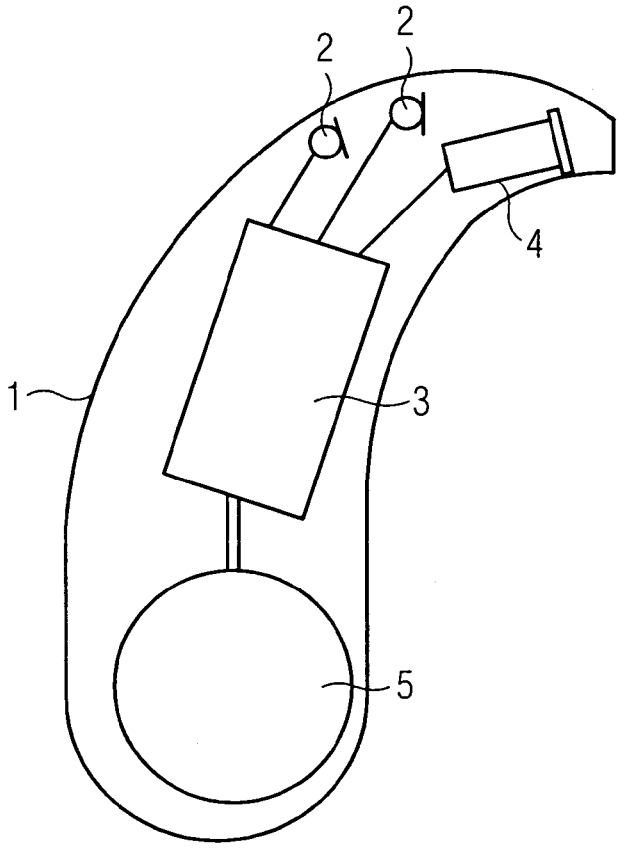
FIG 1 (Prior art)
FIG. 1 shows the basic design of a hearing device according to the prior art.
Figure 2:
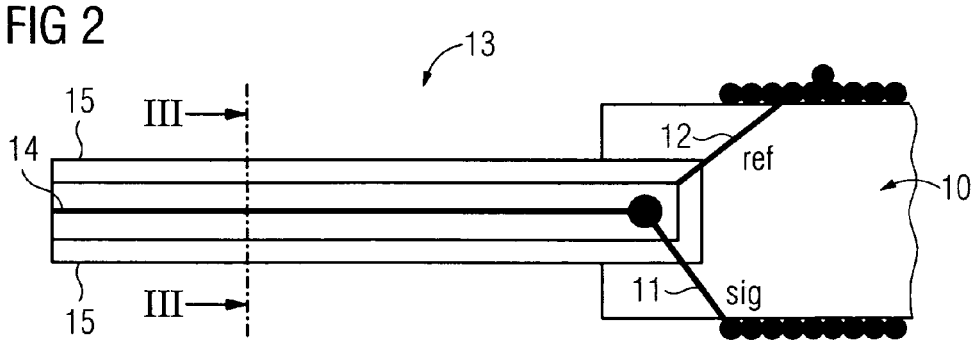
FIG. 2 shows the supply line of a coil with a film conductor according to the present invention.

FIG. 2 symbolically shows part of an antenna coil 10 wound in one layer. The first winding end 11 represents the signal line input sig. The second winding end 12, which is simultaneously used for shielding purposes (cf. FIG. 8) is placed on a shielding and/or reference potential. The two winding ends 11 and 12 are connected to a film conductor 13. The first winding end 11 is concretely connected to a signal line 14 of the film conductor 13 and the second winding end 12 is connected to a shielding line 15. The instance is thus shown here in which the antenna with a terminal is connected to a reference potential (ground or supply voltage) and a shielding layer and/or the shielding line 15 of the film conductor 13 is used for this terminal.

Figure 3:
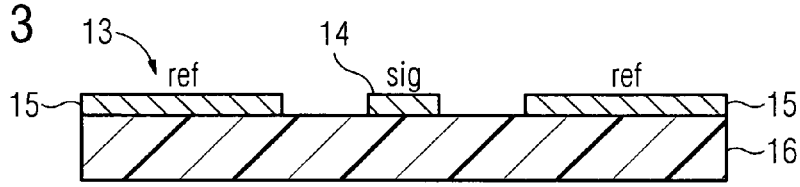
FIG. 3 shows a cross-section of the supply line in FIG. 2.

FIG. 3 shows a section III/III through the film conductor 14 in FIG. 2. Accordingly, a conductor layer is located on a backing film 16, said conductor layer being laterally discontinued twice. As a result, three lines result: in the center the signal line 14 and left and right thereof the shielding line 15, which are connected to one another at the end of the film conductor 13.

Figure 4:
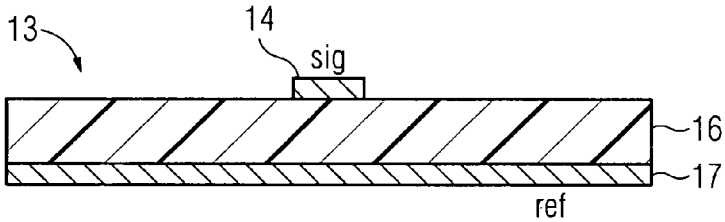
FIG. 4 shows a first alternative of a supply line.

FIG. 4 shows an alternative film conductor 13. It has a signal line 14 running in the longitudinal direction on the one flat side, like the film conductor in FIG. 3. A metal coating is likewise located on the other flat side of the backing film 16 (in FIG. 4 the underside), which is used as a shielding line 17. The backing film 16 is located here between the signal line 14 and the shielding line 17.

Figure 5:
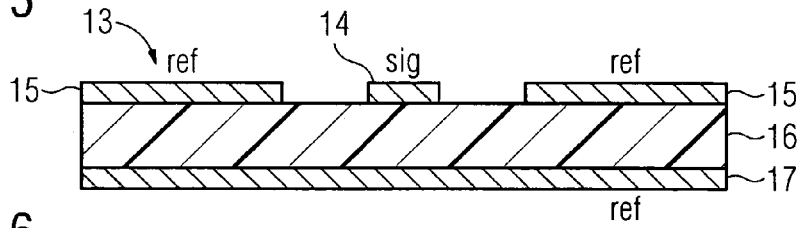
FIG. 5 shows a second alternative of a supply line.

A further exemplary embodiment of a film conductor with a shielding is reproduced in FIG. 5. This design represents a combination of the conductor superstructures of FIGS. 3 and 4. The signal line 14 and the shielding line 15 are arranged on the topside of the backing film 16, as in the example in FIG. 3, whereas the additional shielding line 17 is arranged on the lower side.

Figure 6:
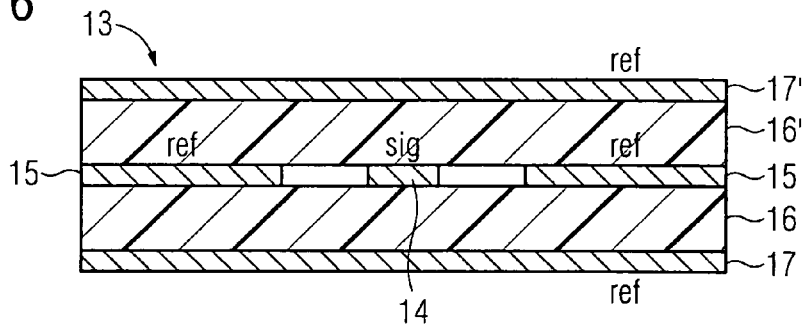
FIG. 6 shows a third alternative of a supply line.

FIG. 6 represents one development of the film conductor 13 in FIG. 5. In addition to the structure in FIG. 5, an additional backing film 16' is arranged over the signal line 14 and the shielding lines 15 and a further additional shielding line 17' is also arranged again thereover. While FIG. 3 thus shows a two-layer design (backing and conductor layer) of the film conductor 13, FIGS. 4 and 5 show a three-layered design and FIG. 6 shows a five-layered design of the film conductor 13. A multi-layered film conductor 13 of this type with an integrated shielding layer can thus realize a space-saving supply line for an inductor antenna.

The shielding of the supply line is of critical importance to the design of critical hearing devices with magnetic data transmission. The selection of the supply line length and the type of positioning of the supply line must as a result be being determined in a considerably less strict fashion. This is particularly meaningful for in-the-ear hearing devices with individually manufactured housing shells. In the hearing devices, parallel oscillating circuits are mostly used advantageously, which due to the excessive voltage in the vicinity of the resonance has a large reception sensitivity and a high frequency selectivity. The shielding achieves an increased signal-to-noise ratio and a suppression of interference signals, which do not lie directly in the vicinity of the working frequency.

The type of supply line shielding particularly effects the antennae, which form part of a parallel oscillating circuit. The construction-specific and mostly not insignificant supply line capacitance may form part of the oscillating circuit capacitance. When using film conductors (cf. FIGS. 3 and 6), the capacitance distribution is very defined and the dielectric losses are very minimal. The capacitance of the shielding can thus be used as a complete part of the effective capacitance. As a result of the clear definability of the shielding capacitance, parallel oscillating circuits can be advantageously developed. This is very difficult with twisted lines, which are usually used in hearing devices, since their capacitance distribution and shielding effect fluctuate significantly. Consequently, a relatively high tuning range in respect of the capacitances is necessary with the known hearing devices. This is generally not possible on a chip (on-chip tuning). Since the inventive use of a film conductor with a defined shielding capacitance introduces fewer capacitance fluctuations, no natural capacitors have to be provided for the tuning of the oscillating circuit, but instead the small capacitors on a chip can be used in a known manner for the tuning.

Figure 7:
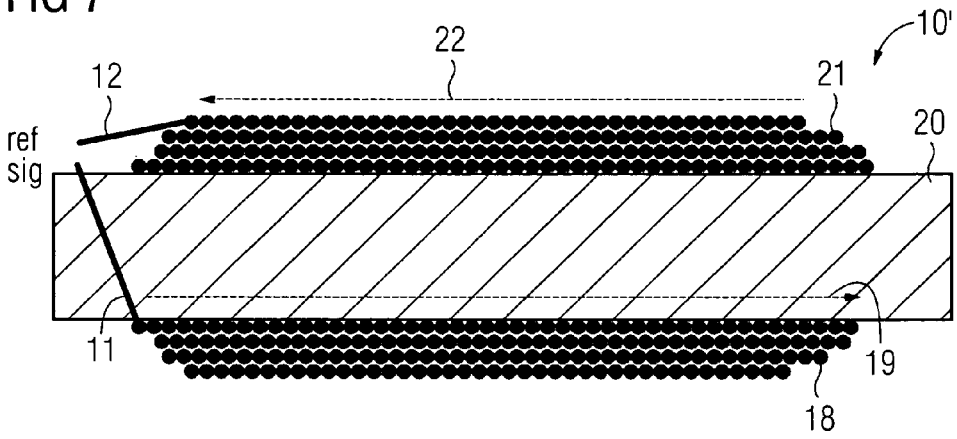
FIG. 7 shows a longitudinal section through a multi-layer antenna coil.
Figure 8:
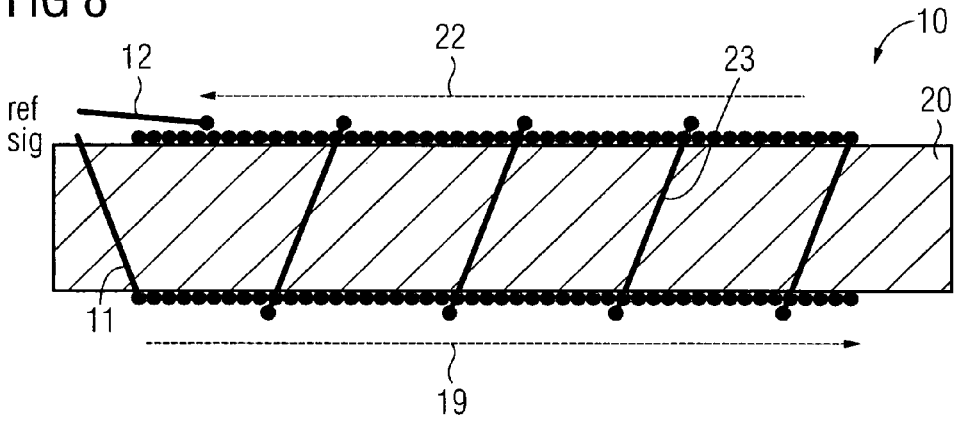
FIG. 8 shows a longitudinal section through a one-layer antenna coil.

A film shielding, as is known from the prior art (U.S. Pat. No. 6,940,466 B2), is not used in the present case for the antenna as a result of the above-mentioned disadvantages. Instead, the antenna coil is structured in a self-shielded fashion, as is shown in FIGS. 7 and 8. FIG. 7 shows a multi-layered wound coil 10' with the winding ends 11 and 12 on one side of the coil 10'. An inner winding layer 18 is wound around a cylindrical ferrite core 20 in a first axial direction 19. An outer winding layer 21 is by contrast wound around the windings arranged below in a second axial direction 22 which is opposite to the first axial direction 19. With this multi-layered wound coil 10', the wire end 12 of the outer winding layer 21 is connected to the reference potential ref. As a result, the outer lying windings only have a minimal potential difference compared with the reference ref and are accordingly insensitive compared with the acting E-fields. Multi-layered wound coils are however only suited to low working frequencies below approximately 2 MHz, due to the low natural resonance. FIG. 8 shows by contrast a figurative longitudinal section through a one-layer wound antenna coil 10. The wire winding with its two winding ends 11 and 12 is wound over the ferrite core 20 in the first axial direction 19. One part of the winding wire in front of the second end 12 is used as a feedback wire 23. To be able to better identify this, FIG. 8 illustrates a cross-sectional view, which is nevertheless shown with a solid line. This feedback wire is guided and wound over the winding layer in the opposite second axial direction 22 and is then connected to the reference potential ref. The feedback level 23 thus lies on reference potential and renders the winding layer positioned therebelow insensitive to the acting E-fields. Such coils are also very well suited to high frequency working frequencies up to approximately 20 MHz.

Figure 9:
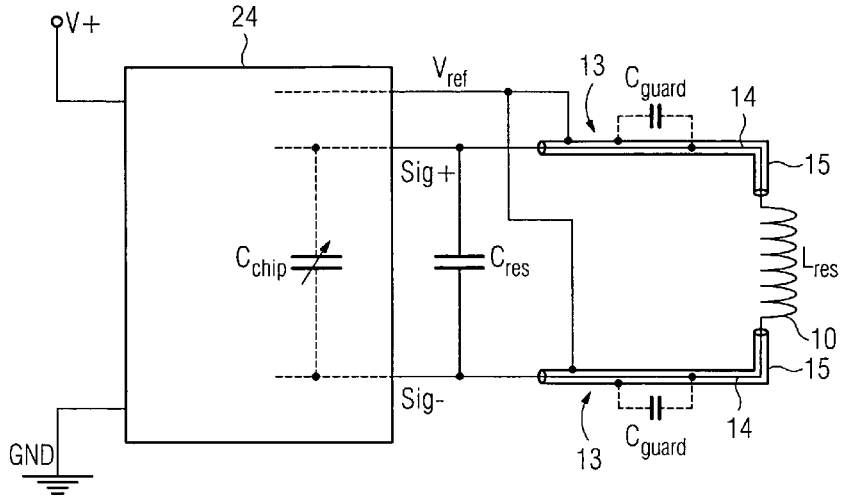
FIG. 9 shows a circuit diagram of an inventive transmission facility.

FIG. 9 shows a circuit diagram of an inventive transmission facility. An oscillating circuit consisting of an antenna coil 10 and/or $L_{res}$ is supplied using a main resonance capacitor $C_{res}$ by a chip 24, which lies on its part on ground GND and is powered by a supply voltage V+. For the oscillating circuit power, the chip 24 makes the signal potentials Sig+ and Sig− available. The potential Sig+ is guided directly to the coil 10 via the signal line 14 of the film conductor 13. The other potential Sig− is applied to the coil 10 via the signal line 14 of a film conductor 13. This circuit plan of the coil 10 represents an equivalent circuit diagram for the coils of FIGS. 7 and 8.

The shielding lines 15 of the film conductor 14 are placed in this example on a special reference potential $V_{ref}$, which is likewise provided by the chip 24. This reference potential $V_{ref}$ is independent of the signal potentials Sig+ and Sig−, which produces a symmetrical circuit of the inductive antenna.

The shield of the film conductor 13 leads to an additional capacitor $C_{guard}$. This, due to the nature of the film conductor, very defined shielding capacitance $C_{guard}$ is parallel to the capacitance $C_{res}$, so that the oscillating circuit capacitance is formed roughly from the total of the capacities $C_{res}$ plus $C_{guard}$. The total oscillating circuit capacitance is however to be tuned precisely, as a result of which tuning capacitors are to be provided in parallel to the main capacitor $C_{res}$ on the chip 24, which are symbolized in the circuit diagram by means of the changeable capacitance $C_{chip}$. As the manufacturing tolerances of the film conductor are particularly low in respect of the shielding, a low tuning range only is required in respect of the oscillating circuit capacitance. This can be realized by the capacitors and/or the changeable capacitance $C_{chip}$ on the chip 24

Figure 10:
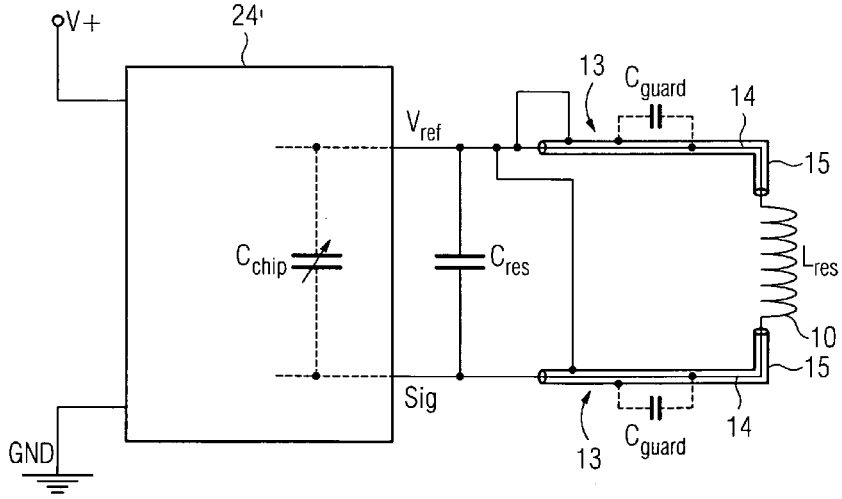
FIG. 10 shows a circuit diagram of an alternative transmission facility.

FIG. 10 shows a further embodiment of the inventive transmission facility. While a symmetrical wiring of the inductive antenna 10, namely with the signal potentials Sig+ and Sig−, is possible with the circuit in FIG. 9, the circuit in FIG. 10 realises a non-symmetrical wiring of the inductive antenna 10. The one terminal of the coil 10 is positioned here across the signal line 14 on reference potential $V_{ref}$. The other terminal of the coil 10 is positioned on signal potential Sig, which is provided like the reference $V_{ref}$ of a chip 24'. The parallel resonance circuit $C_{res}$, $L_{res}$ thus lies on the two potentials $V_{ref}$ and Sig. The shielding line 15 with the signal line 14 is short-circuited at one end of the film conductor 13. The antenna still only has two terminals, instead of three, despite the shielding (cf. FIGS. 7 and 8). This is particularly important for the miniaturization since only two of the relatively large surface terminal pads have then to be retained. To prevent current loops, provision is also advantageously made for the shielding layer and/or the shielding line 15 to only be connected to one side of the film conductor 13 with the reference potential terminal $V_{ref}$.

The invention claimed is:

1. A transmission unit for a hearing apparatus, comprising:
an oscillating circuit comprising a capacitor and a coil;
an electrical supply line arranged in the oscillating circuit comprising a film conductor;
a signal line arranged in the electrical supply line; and
a shielding line arranged in the electrical supply line comprising a shielding capacitance connected in parallel to the capacitor to form an oscillating circuit capacitance,
wherein a variable tuning capacitor integrated in a semiconductor chip is connected to the capacitor.

2. The transmission unit as claimed in claim 1, wherein the coil comprises a natural shielding formed by a wire winding.

3. The transmission unit as claimed in claim 2, wherein the wire winding comprises a first wire end and a second wire end.

4. The transmission unit as claimed in claim 3, wherein the wire winding is formed in one layer in an axial direction starting at the first wire end.

5. The transmission unit as claimed in claim 4, wherein a wire section on the second wire end is guided as a shield directly over the wire winding opposite to the axial direction.

6. The transmission unit as claimed in claim 5, wherein the wire section is wound with fewer windings than the wire winding.

7. The transmission unit as claimed in claim 1, wherein the signal line and the shielding line are short-circuited at one end of the electrical supply line.

8. The transmission unit as claimed in claim 1, wherein the film conductor comprises a conductor layer for the signal line and the shielding line.

9. The transmission unit as claimed in claim 8, wherein the conductor layer is laterally discontinued.

10. The transmission unit as claimed in claim 1, wherein the film conductor comprises a plurality of conductor layers for the signal line and the shielding line.

* * * * *